US005613244A

United States Patent [19]

Oden et al.

[11] Patent Number: 5,613,244

[45] Date of Patent: Mar. 18, 1997

[54] PROCESS FOR PREPARING LIQUID WASTES

[75] Inventors: Laurance L. Oden; Paul C. Turner, both of Albany; William K. O'Connor, Lebanon; Jeffrey S. Hansen, Corvallis, all of Oreg.

[73] Assignee: United States of America, Washington, D.C.

[21] Appl. No.: 533,978

[22] Filed: Sep. 26, 1995

[51] Int. Cl.[6] ..... G21F 9/00

[52] U.S. Cl. ..... 588/20; 588/11; 588/252; 976/DIG. 385

[58] Field of Search ..... 588/20, 11, 252; 976/DIG. 385

[56] References Cited

U.S. PATENT DOCUMENTS

| | | | |
|---|---|---|---|
| 4,119,561 | 10/1978 | Drobnik et al. | 252/301.1 W |
| 4,312,774 | 1/1982 | Macedo et al. | 252/629 |
| 4,424,149 | 1/1984 | Bege et al. | 252/629 |
| 4,636,335 | 1/1987 | Kawamura et al. | 588/11 |
| 4,654,172 | 3/1987 | Matsuda et al. | 588/11 |
| 4,666,490 | 5/1987 | Drake | 65/27 |
| 4,898,692 | 2/1990 | Rajan et al. | 588/11 |
| 5,340,506 | 8/1994 | Koyama | 588/14 |
| 5,348,689 | 9/1994 | Gay et al. | 588/18 |
| 5,374,307 | 12/1994 | Riddle | 106/705 |

*Primary Examiner*—Ngoclan Mai
*Attorney, Agent, or Firm*—E. Philip Koltos; Albert A. Kashinski; William R. Moser

[57] ABSTRACT

A process for preparing radioactive and other hazardous liquid wastes for treatment by the method of vitrification or melting is provided for.

9 Claims, No Drawings

PROCESS FOR PREPARING LIQUID WASTES

BACKGROUND OF THE INVENTION

Field of the Invention

The present invention relates generally to vitrifying or melting liquid wastes for which additional materials are needed to form a desired glass or slag composition, and more particularly to a process for vitrifying low-level radioactive high-sodium liquid wastes.

BACKGROUND OF THE INVENTION

Vitrification or melting of liquid Bastes requires that other materials be added to the waste, so that upon melting, a glass or slag material is formed that is resistant to natural forces such as leaching, decrepitation, and abrasion. These additional materials constitute a significant proportion of the final form, usually in the range of 70 to 80 percent by weight. The appropriate glass or slag formers, which are well known to those experienced in the art consist of metal oxides, such as boric, calcia, alumina, silica, magnesia, and others, such as titania and zirconia, to achieve special properties.

Previous to the present invention, waste processors would feed glass or slag forming minerals and low-level radioactive high-sodium liquid wastes directly into the melting furnace for vitrification. This seemingly simpler procedure results in the formation of large volumes of gases containing nitrogen oxides formed by thermal decomposition of nitrates and nitrites in the waste. Nitrogen oxides pose a significant health hazard, and the gas thus generated must be treated to remove them. The present invention provides an improved technology wherein nitrates and nitrites are decomposed into nitrogen gas in a separate operation, and dry feed materials are processed by the melting furnace.

SUMMARY OF THE INVENTION

It is therefore an object of the present invention to provide a process for preparing radioactive and other hazardous liquid wastes for treatment by the method of vitrification or melting.

DETAILED DESCRIPTION OF THE INVENTION

The preferred embodiment of the present process involves the following steps:

1. Mixing of finely divided dry material including glass-forming minerals, binders to impart physical strength to intermediate product pellets, and reductants to decompose nitrogenous species in the liquid waste.

2. Pelletizing of mixed dry materials with water to form wet pellets, bricks, briquettes, plates, extrudates, or other shape by conventional methods including mixing, rolling, compacting, extruding (ring pelletizer), agglomerating (disc pelletizer), or other technique.

3. Heating to 50° to 120° C. to remove free moisture and to form dry physically strong intermediate product pellets with capacity to absorb liquid waste.

4. Exposing dry pellets to liquid waste by spraying, dipping, or other means to prepare loaded pellets. Proportions are determined by the extent of waste loading desired in the final waste form and the concentrations of components within the liquid waste. Proportions appropriate to treat the subject liquid waste are cited in examples 1, 2, and 3.

5. Heating loaded pellets to 50° to 120° C. to remove free moisture and further heating to 150° to 450° C. to induce reaction between reductants in the pellets and nitrogenous species in the liquid waste to prepare a dry homogeneous product suitable for melting.

The invention specifically is applicable to the low-level radioactive high-sodium liquid wastes, such as those currently stored in underground tanks at the Hanford Nuclear Reservation in Washington State, but it also is applicable to the vitrification or melting of other liquid wastes requiring the addition of glass-forming materials such as Hanford site high-level liquid wastes and liquid wastes hazardous by virtue of contained heavy metals and other RCRA-listed materials. However, it is understood that the invention is broad in scope and is neither dependent upon addition of materials to react with the wastes nor chemical reaction of materials within the substrate. That is, the substrate may function only as a carrier for the appropriate hazardous component or components in the liquid waste.

EXAMPLES

Example 1

Furnace ready feed material was prepared from glass-forming minerals, organic reductants, and simulated high-sodium low-level liquid waste having the composition listed in Table 1. The resulting 3,925 pounds of furnace feed were melted to form a fluid glass that tapped readily from the electric furnace at 1,350° C. Appropriate weights of glass-forming minerals, reductants, binder, and simulated low-level liquid waste to prepare 420-pound batches are as follows:

TABLE 1

Composition of Hanford-Site Low-Level Liquid Waste

| Component | Concentration grams/liter | Concentration wt percent |
|---|---|---|
| A1203 | 51.439 | 3.544 |
| Ca0 | 0.040 | 0.003 |
| Cr203 | 0.648 | 0.045 |
| Cs20 | 2.349 | 0.162 |
| Fe203 | 0.040 | 0.003 |
| K20 | 23.370 | 1.610 |
| Mg0 | 0.040 | 0.003 |
| Mn02 | 0.040 | 0.003 |
| Mo03 | 2.390 | 0.165 |
| Cl | 5.627 | 0.388 |
| F | 4.710 | 0.324 |
| I | 2.092 | 0.144 |
| Na20 | 307.449 | 21.181 |
| P205 | 3.038 | 0.209 |
| SO3 | 3.443 | 0.237 |
| SrO | 1.701 | 0.117 |
| Subtotal (inorganic components) | 408.42 | 28.14 |
| CO2 | 16.010 | 1.103 |
| H2O | 672.746 | 46.348 |
| NO3— | 196.326 | 13.526 |
| NO2— | 76.660 | 5.281 |
| OH— | 65.183 | 4.491 |
| Org C | 16.173 | 1.114 |
| Subtotal (volatile components) | 1043.10 | 71.863 |
| Total (all components) | 1451.51 | 100.00 |

1.1 Pellet production: Finely divided dry solids comprising 19.25 lb Bayer alumina, 37.52 lb boric acid, 12.64 lb southern bentonite, 178.20 lb diatomite, 64.50 lb Micro-Cel, 34.68 lb minus 200 mesh silica, 11.79 lb powered sugar, and 11.03 lb activated carbon were mixed for 10 min in a 100 cubic foot capacity double-ribbon mixer. The mixed materials were pelletized with water spray on a 36-inch diameter disc pelletizer to prepare wet pellets. Wet pellets then were heated to 100° C. in an oven overnight to prepare physically strong dry pellets as an intermediate product.

1.2. Furnace feed preparation: Dry intermediate product pellets in 50-lb batches were sprayed with 51 lb of low-level liquid waste while being tumbled in a conventional cement mixer to prepare wet loaded pellets, which were spread on a conveyor belt and heated for 1 hour by infrared heaters to remove about 30 percent of the free moisture. The partially dried pellets then were further heated to 350° C. in 20 minutes within a steel-belt dryer to complete water removal and to cause reaction of sugar and carbon in the pellets with nitrates and nitrites in the low level liquid waste to evolve nitrogen, carbon dioxide, and water as gases. The resulting product constitutes dry homogeneous denitrified furnace feed which produced glass with 25 pct waste loading. Chemical reactions to decompose sodium nitrate and sodium nitrite with sugar and carbon are given by equations A, B, C, and D.

Sucrose reductant:

Equation A. $5\ C_{12}H_{22}O_{11}+48\ NaNO_3 \longrightarrow 24\ Na_2O+24\ N_2+60\ CO_2+55\ H_2O$ Equation B. $3\ C_{12}H_{22}O_{11}+48\ NaNO_2 \longrightarrow 24\ Na_2O+24\ N_2+36\ CO_2+33\ H_2O$ Carbon reductant:

Equation C. $5\ C+4\ NaNO_3 \longrightarrow 2\ Na_2O+2N_2+5\ CO_2$

Equation D. $3\ C+4\ NaNO_2 \longrightarrow 2\ Na_2O+2N_2+3\ CO_2$.

The invention is illustrated in Example 1 for a substrate which contains boria, alumina, calcia, and silica as major components after reaction, but other compositions readily recognizable by one versed in the art are also claimed. Further treatment of the substrate by addition of chemical species or thermal treatment to modify physical properties including but not limited to, strength, porosity, and surface area are within the purview of the invention. Also claimed is the addition of catalytic materials to achieve desired reactions or to modify reaction mechanisms or temperature.

Reaction of components or additives within the substrate constitutes an essential element of the example illustrated in Example 1, however it is understood that the invention is not dependent upon chemical reaction within the substrate. The substrate may function only as a carrier for the appropriate hazardous component or components in the liquid waste. It is further understood that the invention is applicable to numerous liquid wastes amenable to treatment by vitrification or melting. It is further understood that the chemical, physical and crystallographic properties of the final waste form are readily modified by post melting thermal treatment such as quenching in water or other liquid, casting onto a cooled substram, programmed cooling, soaking at a temperature below the melting temperature, or reheating of programmatically cooled material.

Extreme and preferred conditions are given below for application of the preferred embodiment of the subject invention to the treatment of low-level radioactive high-sodium liquid wastes currently stored in underground tanks at the Hanford Nuclear Reservation in Washington State.

Composition of the substrate: The preferred composition is 10.15 pct boric acid, 5.21 pct Bayer alumina, 3.42 pct southern bentonite, 48.21 pct diatomite, 17.45 pct Micro-Cel, 9.38 pct minus 200 mesh silica, 3.19 pct powdered sugar, and 2.99 pct activated carbon, where ingredients were selected to provide dry pellets with physical strength to withstand normal handling and absorptive capacity to provide 25 pct waste loading in product glass. Boric acid is technical grade material with the formula $H_3BO_3$; Bayer alumina is "cell grade" aluminum oxide containing 0.2 to 0.5 pct $Na_2O$ as major impurity, as used by the aluminum industry in electrolytic reduction cells; southern bentonite, the binder material for dry intermediate product pellets, was selected to contain minimum sodium; diatomite is an abundant mineral with large specific surface area containing about 85 pct $SiO_2$; minus 200 mesh silica is a readily available industrial mineral, Micro-Cel (Trademark of Celite Corp.) is a commercially prepared synthetic calcium silicate having large specific surface area, powdered sugar is either beet or cane sugar, and activated carbon is NUSORB LN100-325X wood-derived activated carbon from NUCON International Inc.

The extreme range of composition is 0 to 20 pct boric acid, 0 to 10 pct Bayer alumina, 0 to 20 pct southern bentonite, 25 to 75 pct diatomite, 0 to 25 pct Micro-Cel, 0 to 25 pct finely divided silica, 0 to 15 pct sugar and 0 to 10 pct carbon. It is understood that the essential oxides can be obtained from numerous minerals and industrial product sources. For example, boria can be obtained from colemanite (calcium borate); alumina can be obtained from mullite (aluminum silicate) or clay; $SiO_2$ can be obtained from silica sand, fumed silica, or clay; and calcia can be obtained from limestone ($CaCO_3$), slacked lime ($Ca(OH)_2$), or quick lime ($CaO$). Southern bentonire is not an essential ingredient of the substrate, in that intermediate pellet binders may be omitted, and other binders, both organic and inorganic, are appropriate under special circumstances. It is further understood that numerous reductants are applicable including but not limited to formic acid, other organic acids, starch, urea, lamp black, other forms of carbon, silicon, aluminum, and other active metals.

Temperature for reaction: The preferred conditions for reaction of the exampled composition is 350° C. Reaction occurs while heating to that temperature. The extreme range for reaction is 150° to 450° C.

Alternative embodiments of the invention: Finely divided solids comprising glass forming minerals and reductants can alternatively be mixed with the subject liquid waste, and the resultant slurry or thick paste can be formed into wet pellets, bricks, briquettes, plates, extrudates, or other shape by conventional methods including mixing, rolling, compacting, extruding (ring pelletizer), agglomerating (disc pelletizer), or other pelletizing technique. The resultant shape can be dried in the temperature range 20° C. to 120° C., and the resultant dried shape can be reacted in the temperature range 150° C. to 450° C. in order to initiate and complete reaction between nitrogenous species and the reductant. The resultant material is indistinguishable from material described in Example 1. However, the latter method introduces the radioactive waste to the glass former materials in the initial operation, and there/ore, requires the treatment and handling of nearly three times more radioactive material than the preferred embodiment.

Example 2

Furnace ready feed material was prepared from glass-forming minerals, organic reductants, and simulated high-sodium low-level liquid waste by the following steps. The resulting 26,155 pounds of furnace feed were melted to form a fluid glass indistinguishable from glass provided by example 1. Appropriate weights of glass formers, reductants, and simulated low-level liquid waste to prepare 485-pound batches of wet pellets are as follows:

1.1 Pellet production: Finely divided dry solids comprising 13.99 lb Bayer alumina, 24.03 lb boric acid, 23.28 lb limestone, 119.19 lb diatomite, 45.12 lb minus 200 mesh silica, 7.55 lb powered sugar, and 7.07 lb activated carbon were mixed for 10 minutes in a 100 cubic foot capacity double-ribbon mixer. Over a 6-minute period of time 239.55 lb of simulated low-level liquid waste was added to the mixer through a distribution pipe extending the length of the mixer. Water (8 lb) then was added over 5 minutes with continued mixing to cause agglomeration resulting in wet loaded pellets.

1.2. Furnace feed preparation: The wet pellets were dried and reacted as described in Example 1 to prepare dry homogeneous denitrified furnace feed.

Glass or slag forming minerals and suitable binders can alternatively be mixed, pelletized, dried, and indurated (sintered) to form rugged pellets to withstand severe physical abuse. Such properties could be required if pellet production facilities were located far from the melter requiring extensive transportation and handling of pellets. In this embodiment the reductant(s) must be dissolved (soluble) in the liquid waste.

Example 3

Furnace ready feed material was prepared from glass-forming minerals, sugar, and simulated high-sodium low-level liquid waste by the following steps. The resulting 26.67 pounds of furnace feed were melted to form a fluid glass indistinguishable from glass provided by examples 1 and 2. Appropriate weights of glass formers, sugar, and simulated low-level high-sodium liquid waste to prepare 26.67 pounds of dry furnace feed are as follows:

3.1. Pellet production: Finely divided dry solids comprising 2.43 lb boric acid, 1.02 lb Bayer alumina, 0.88 lb southern bentonite, 13.57 lb diatomite, and 4.20 lb Micro-Cel were thoroughly mixed, and the mixture was pelletized with water spray on a disc pelletizer. The resulting wet pellets were dried at 100° C. overnight, and then indurated (sintered) for 1 hour in air at 800° C. to prepare 20.00 lb of indurated pellets.

3.2. Conditioning of liquid waste: Common beet sugar, 2.97 lb, was dissolved in 1.80 lb water, and the resulting solution was added with stirring to 23.69 lb of simulated high-sodium low-level liquid waste.

3.3. Furnace feed production: Indurated pellets (20.00 lb) prepared in step 3.1 were sprayed with the conditioned liquid waste (28.46 lb) prepared in step 3.2 to prepare 48.46 lb of wet loaded pellets. The wet loaded pellets were dried at 100° C. overnight and then were heated to 250° C. to cause reaction of sugar with nitrates and nitrites to evolve nitrogen, carbon dioxide, and water as gases. The resulting product, 26.67 lb, constitutes dry homogeneous denitrified furnace feed providing 25 pct waste loading in product glass.

What is claimed is:

1. A process for treating liquid wastes comprising:

mixing finely divided dry solid glass-forming minerals and reductant(s);

forming the mixture with water into pellet, brick, briquette, plate, extrudate, or agglomerate by conventional methods including mixing, rolling, compacting, extruding, agglomerating, or other pelletizing technique;

heating the resulting substrate in the temperature range 50° to 120° C. to remove free moisture;

allowing absorption of the liquid waste to occur by the substrate;

drying the loaded substrate in the temperature range 50° to 120° C. to remove free moisture;

heating the dry intermediate product to the temperature range 150° C. to 450° C. in order to initiate and complete reaction between nitrogenous species in the liquid waste and any reductant; and heating the denitrified material by any means to cause melting.

2. The method of claim 1, wherein the liquid waste is hazardous.

3. The method of claim 1, wherein the composition of glass-forming minerals and reductants is 0 to 20 percent boric acid, 0 to 10 percent alumina, 0 to 20 percent southern bentonite, 25 to 75 percent diatomite, 0 to 25 percent Micro-Cel (synthetic calcium silicate by Celite Corp.), 0 to 25 percent silica, 0 to 15 percent sugar, and 0 to 10 percent activated carbon.

4. A method of claim 3 wherein the preferred composition of glass forming minerals and reductants is 10.15 percent boric acid, 5.21 percent Bayer alumina, 3.42 percent southern bentonite, 48.21 percent diatomite, 17.45 percent Micro-Cel, 9.38 percent minus 200 mesh silica, 3.19 percent powdered sugar, and 2.99 percent activated carbon.

5. A method of claim 1, which further comprises an additional step chosen from the group consisting of: post melting thermal treatment by quenching in water or other liquid; casting onto cooled substrate; programmed cooling; soaking at a temperature below the melting temperature; or reheating of programmatically cooled material.

6. A method to treat liquid waste comprising:

mixing finely divided dry solid glass-forming minerals and reductant(s) with liquid waste;

forming the resultant thick paste or slurry into pellet, brick, briquette, plate, extrudate, or agglomerate by conventional methods including mixing, rolling, compacting, extruding, agglomerating, or other pelletizing technique;

heating the resulting substrate to the temperature range 50° to 120° C. to remove free moisture;

heating the dry intermediate product to the temperature range 150° C. to 450° C. in order to initiate and complete reaction between nitrogenous species in the liquid waste and any reductant; and heating the denitrified material by any means to cause melting.

7. The method of claim 6, wherein the liquid is hazardous.

8. A process for treating liquid wastes comprising:

mixing finely divided dry solid glass-forming minerals;

forming the mixture with water into pellet, brick, briquette, plate, extrudate, or agglomerate by conventional methods including mixing, rolling, compacting, extruding, agglomerating, or other pelletizing technique;

heating the resulting shape in the temperature range 50° to 120° C. to remove free moisture;

indurating (sintering) the resulting substrate to prepare a physically strong substrate;

adding any requisite reductant to the liquid waste, as determined by the appropriate chemical reaction;

allowing absorption of the solution of liquid waste and reductant to occur by the substrate;

drying the loaded substrate in the temperature range 50° to 120° C. to remove free moisture;

heating the dry intermediate product to the temperature range 150° C. to 450° C. in order to initiate and complete reaction between nitrogenous species in the liquid waste and any reductant; and heating the denitrified material by any means to cause melting.

9. The method of claim 8, wherein the liquid waste is hazardous.

* * * * *